US008987643B2

(12) United States Patent
Vempati Venkata

(10) Patent No.: US 8,987,643 B2
(45) Date of Patent: Mar. 24, 2015

(54) CERAMIC MONOLITH AND AN ELECTRIC HEATING DEVICE INCORPORATING THE SAID MONOLITH

(76) Inventor: Sundereswar Rao Vempati Venkata, Secunderabad (IN)

( * ) Notice: Subject to any disclaimer, the term of this patent is extended or adjusted under 35 U.S.C. 154(b) by 704 days.

(21) Appl. No.: 13/321,618

(22) PCT Filed: Jul. 20, 2009

(86) PCT No.: PCT/IN2009/000415
§ 371 (c)(1),
(2), (4) Date: Nov. 21, 2011

(87) PCT Pub. No.: WO2011/010317
PCT Pub. Date: Jan. 27, 2011

(65) Prior Publication Data

US 2012/0061379 A1 Mar. 15, 2012

(51) Int. Cl.

| | |
|---|---|
| ***H05B 3/10*** | (2006.01) |
| ***H05B 3/50*** | (2006.01) |
| ***F24H 3/04*** | (2006.01) |
| ***F24H 9/18*** | (2006.01) |

(52) U.S. Cl.
CPC ..... *H05B 3/50* (2013.01); *F24H 3/0405* (2013.01); *F24H 3/0429* (2013.01); *F24H 9/1863* (2013.01); *H05B 2203/023* (2013.01)
USPC ..... 219/553; 219/536

(58) Field of Classification Search
USPC ..... 219/532, 541–542, 546, 536–537, 548, 219/552, 550; 315/111.21; 428/116–117
See application file for complete search history.

(56) References Cited

U.S. PATENT DOCUMENTS

| | | | | |
|---|---|---|---|---|
| 3,883,721 | A | 5/1975 | Paulson et al. | |
| 4,250,399 | A | 2/1981 | King | |
| 4,458,141 | A | 7/1984 | Howard et al. | |
| 4,528,441 | A | 7/1985 | Seal et al. | |
| 4,692,599 | A | 9/1987 | Howard et al. | |
| 5,122,640 | A | 6/1992 | Holmes | |
| 5,925,273 | A | 7/1999 | Sherrill | |
| 6,884,974 | B2 | 4/2005 | Howard et al. | |
| 2002/0139793 | A1* | 10/2002 | Whitfield | 219/536 |
| 2006/0152163 | A1* | 7/2006 | Miki et al. | 315/111.21 |

FOREIGN PATENT DOCUMENTS

| | | | |
|---|---|---|---|
| IN | 200787 | B | 2/2007 |

OTHER PUBLICATIONS

International Search Report dated Jun. 15, 2010 in corresponding International Application No. PCT/IN2009/000415.

* cited by examiner

*Primary Examiner* — Dana Ross
*Assistant Examiner* — Phuong Nguyen
(74) *Attorney, Agent, or Firm* — Law Offices of Steven W. Weinrieb

(57) ABSTRACT

The present invention relates to an improved electrical heating device for forced convection heating as well as for radiant heating, the device having minimum number of element supporting components and with the heating element held and supported between two parallel walls of a modified ceramic honeycomb, in such a way that the supported element is perpendicular to the direction of the air flow while being open to air flowing through the channels the heating element being also protected from direct physical contact with the metallic body of the outer shell/enclosure.

24 Claims, 4 Drawing Sheets

$B_h$

PRIOR ART

CERAMIC MONOLITH AND AN ELECTRIC HEATING DEVICE INCORPORATING THE SAID MONOLITH

FIELD OF INVENTION

The present invention relates to an improved ceramic honeycomb monolith and an electrical heating device incorporating the said monolith. The present invention more particularly relates to an improved electrical heating device for forced convection heating as well as for radiant heating. The present invention relates to an improved electrical heating device with minimum number of element supporting components and with the heating element held and supported between two parallel walls of a modified ceramic honeycomb monolith in such a way that the supported element is perpendicular to the direction of the air flow while being open to air flowing through the channels. The present invention also relates to an improved electrical heating device wherein the heating elements are protected from direct physical contact with the metallic body of the outer shell/enclosure thereby making it probably the safest resistance heater with high convection efficiency.

The electrical heating device of the present invention provides a perfect insulation between each of the individual element windings involved and also provides a good insulation between the heater and the outer container while ensuring a near perfect contact between the air and the heating element, owing to the unique heater configuration by way of a most effective combination of a modified ceramic honeycomb monolith with a single or a group of heating elements in a predetermined manner so as to prove maximum exposure of heating element with the passing air and ensuring excellent insulation, improved mechanical support and optimum heat transfer and improved watt density.

The improved electrical heating device of the present invention is useful in many applications requiring hot air and also in applications with space constraints faced while accommodating other means of resistance heaters. The improved electrical heating device of the present invention is highly compact, energy efficient, offers better insulation between each element and attempts to eliminate the sagging effect on heating while minimizing the possibilities of noise generally associated with supported heating elements.

PRIOR ART

Convective air heating is an operation involving a medium for heat transfer and a heat source. Only when these two components interact in a most optimum way, the heating device functions without failure. The device can not function fully if the heat source has physical limitations like poor insulation between windings or weak insulation between electrical heating element and the support system.

Conventional air heaters with bare electrical heating element have many limitations and have always been dependant on carefully laid out and extensive, insulation/support system to ensure sufficient safety standards as well as certain minimum levels of insulation in between the elements and also the holding assembly to avoid any short circuiting.

Most prior art devices depend heavily on extensive support system involving a number of associated components, so much so, that numerous designs of even the supporting ceramics came into existence. This has a major impact on the design of the heater itself as the designer has to consider spacing and accommodation of not only the elements but also so many components, which limit the design capabilities.

This also limits the watt density to a certain extent in a unit area while increasing the assembly and production time.

The Indian Patent No 200787 dated 7 Jan. 1999 discloses a ceramic monolith honeycomb body supporting the heating elements which is oven through the essentially parallel honeycomb channels such that the entire heating element passes through the channels up and down while ensuring that the element passes through each channel only once and both the ends of the heating element are terminated on the cold air inlet end of the honeycomb by way of crimping to two terminal electrodes which are cemented into two empty channels with a suitable ceramic cement. Such a Ceramic monolith honeycomb body is shown in FIG. 1 of the drawing accompanying this specification. From the FIG. 1 it can be seen that a ceramic honeycomb monolith body (6) made of any suitable ceramic material is provided with plurality of parallel channels or holes. An electrical resistance heating element (5) is woven through the channels or holes of this ceramic honeycomb monolith body (6). This ceramic honeycomb monolith body is in turn fitted into the main body (1) of the air heater with a provision for air inlet (2) and air out let (3). The terminal electrodes are positioned on the air inlet side of the heater. The channels or holes also act as passages for air when air is blown through them. A predetermined number of channels or holes are woven with the heating element. When the electrical resistance element is energized, and when air is blown through the channels or holes from the air inlet end (2), the heat generated in the electrical heating element is efficiently transferred to the air flowing out and along the heating element in the channels or holes. The air flowing in the space between the element and the four walls of the channel or holes, ensures a close and prolonged contact resulting in improved convection efficiency. However this prior art has one serious limitation by way of a temperature gradient that exists in the heating element, caused by the gradual raise in air temperature and the relative change in temperature differential as the air travels from inlet to outlet end. This temperature gradient may cause early failure of the heating element when the peak temperature of the element at the exit end reaches dangerous levels. This limits the maximum temperature that can be achieved using this device.

Therefore this device needs to be modified in such a fashion that the heating element achieves a uniform temperature along its entire length while ensuring that the entire heating element is completely and continuously in close contact with the flowing air and vice versa.

U.S. Pat. No. 3,883,721 dated 13 May 1975 discloses an open coil electric heater as shown in FIG. 2. The heater has a heating coil (16) which is carried by a metal base member (10) and metal frame work which includes metal arms (11), plurality of metal supports (14) having openings therein. Insulating bushes (20) fit within respective openings and the coil passes through the insulating bushings and thus is insulated from the metal supports.

The above device provides very high inter row space to avoid element to metal support contact there by making the device bulky and of lower watt densities. The element gets support only at a few locations along the length, as more number of bushes will occupy more open area resulting in reduced air movement.

U.S. Pat. No. 4,250,399 dated Feb. 10, 1981 discloses an open coil electric heater as shown in FIG. 3. The heater comprising a rigid support frame composed of a pair of longitudinally extending laterally spaced member, with cross members (14) secured between the longitudinal members. The cross members carry ceramic coil supports (18) which are detachably connected to the cross members (14). Each coil support has an end formed with a cross slot to pass a part of a convolution of a coil and hook like projection are formed on opposite sides of a coil support and are co-operable with the coil convolution part to detachably hold the same to the coil support. The heating coil W is secured to the coil supports in expeditious manner and without the use of tools by twisting the coil so that said convolution part is aligned sufficiently with said cross slot to enable said part to be seated within said slot.

The above described heater is time consuming to assemble resulting in low production. This heater involves too many components to assemble resulting in unnecessary labor wastage, higher costs of production and lower watt density.

U.S. Pat. No. 4,458,141 dated 3 Jul. 1984 discloses a heater which is shown in FIG. 4. It comprises of a frame (12) insulated from an electric resistance heater coil (24) by insulated supports (34) mounted within beam members (18) of the frame (12). The supports incorporate structural features enabling the use of supporting beams. The support insulators include additional structural features for retaining the resistance wire in place and for engagement therewith. The insulators many project on both sides of the support beams and retain heater wires in two places. The support insulators further provide an integrated structure fabricated and assembled to the frame.

The above device is also time consuming to assemble and is costly due to the multi component arrangement involved and the resultant heater is bulky and also requires large space to accommodate higher wattages.

U.S. Pat. No. 4,528,441 dated 9 Jul. 1985 discloses an electrical resistance heating assembly which is shown in FIG. 5. The assembly has specially designed arms, shaped to retain an electrical resistance heating coil (8), which can be mounted on arms of the insulator (10). Top parts of the arms are generally rectangular or triangular in cross section and the arms are spaced and configured relative to each other to form a generally T-shaped opening between the arms, with the ends of the cross bar (5) of the T-shaped opening forming electrically resistant heating coil retention surfaces. Cuts in side surfaces of the insulators providing additional coil retention surfaces The insulators have either an extended base portion for directly mounting the insulators to a mounting bar (6) of the electrical resistance heating assembly or the insulators simply comprise slabs of electrically insulating material which are each mounted on a cross bar (5) which is attached to a mounting bar of the electrical resistance heater assembly.

The above heater also takes more time to assemble resulting in low production, and the cost of production is also high due to the multiple numbers of components.

U.S. Pat. No. 5,122,640 dated 16 Jun. 1992 discloses a heater, which is shown in FIG. 6. It consists of an insulating support 12 for a helical wire heating coil 11 includes a coil supporting notch 25 into which a single helical coil turn is inserted and locked into position without twisting the coil and without unduly stretching the coil in an axial direction. The supporting notch includes lead-in ramp surfaces to spread the two halves of the coil turn until the coil is centrally positioned in the notch, whereupon the coil turn snaps into locking engagement with four separate abutments to prevent dislodgement. A central portion in the notch includes a separate coil supporting surface that limits further movement of the coil into the notch and notch also includes interior lateral abutment surfaces to engage the outside of the coil turn and prevent lateral movement in the notch. The faces of the support body adjacent to the notch are engaged by opposite half portions of the coil turn to preclude axial movement of the coil once it is locked in position.

The problem with the above device is the relatively large ceramic insulation supports are heavy and expensive to manufacture. A fair portion of the coil contacts the surface of the insulating supports. This type of heater may lead to hot spots and early element failure. In addition, the construction of the heater also inhibits good air circulation.

U.S. Pat. No. 5,925,273 dated 20 Jul. 1999 discloses an electric multi-stage heater assembly which is shown in FIG. 7. This assembly provides for multilevel heating using a plurality of separately controllable heating elements (10*a* & 10*b*) within a housing that is readily interchangeable with standard single stage heater housings that can be controlled by conventional power switching circuits. This multistage heater assembly has each electric heater element straddling a support member with a portion of the heater element extending from one side to the other to maintain the electrical continuity of the element. The support member (14) has a plurality of cutouts that provide space for routing the cross over portion (22*a* & 22*b*) of the heater element and sufficient clearance to accommodate the inevitable droop associated with heat cycling electric resistive heater elements. The support member is equipped with a plurality of insulators, which support and electrically insulate the heater elements. The insulators are arranged to co operatively rotate with in the support member to minimize sagging of the heater elements.

The above device incorporates multiple numbers of components resulting in increased time for production, resulting in low production, low watt density and is also labor intensive. The heater is also expensive due to the multiple components required to assemble the heater.

U.S. Pat. No. 6,884,974 dated 26 Apr. 2005 discloses a mica board open coil resistance heater assembly which is shown in FIG. 8. The assembly includes a mica board subassembly of at least one pair of mica boards (20), a resistance wire wound around the boards, an electrical connection clip (10) secured to each mica board, wherein each end of the resistance wire is connected to a respective clip. A terminal plate subassembly (51) includes a thermostat, a ceramic two hole terminal block (55), and bus wires (65 & 67), the bus wires adapted to be attached to a portion of the electrical connection clip to connect the resistance wire to power. The ceramic two hole terminal (75 & 77) is able to receive push on terminals from power conductors.

In spite of the ceramic two whole terminals provided in the above heater to accommodate push on terminals, a mica insulator will always face strength constraints and limit the design capabilities of the heater assembly.

The above prior art documents have all disclosed some modifications in their own preferred areas and except for the prior art Indian patent number 200787, non of the other prior arts disclosures have dealt with a heater with a single support component performing the functions of holding, insulating, aligning and separation and preventing the effects of sagging while conditioning the heater itself to perform most efficiently. However the device disclosed in the Indian patent no 200787 has serious limitations owing to the temperature gradient along the length of electrical resistance wire present in each channel, particularly making the portion of the heating element at the exit end vulnerable to high temperature and subsequent failure. The watt density is also low.

No effort has been made to develop a support arrangement for the electrical heating element by which a single or two piece monolithic ceramic bodies, devoid of multiple metallic support structures involving insulators, separators, fasteners etc, and which can function as an excellent insulating support frame with inbuilt element separation mechanism.

Summing up, the prior art disclosures suffer from the following often observed limitations;

1). The heating element is supported on a frame by means of insulators, brackets and fasteners and cross channels. The support is intermittent and not continuous resulting in excessive sagging of the heating element on heating.

2). The insulators and brackets are external components to the frame, necessitating fastening and extra labor resulting in higher cost of production and higher bulk of the heater 3). The inter element gap has to be more to accommodate for sagging and inclusion of supports in between the rows, resulting in widely spread heating element and reducing efficiency of the heater 4). Heaters have to be designed carefully when employing a straight wire as accommodating longer element lengths will demand larger surface area for proper inter winding space. This leads to reduced watt densities.

5). Heating units of this prior art disclosures are generally found to be bulky and consume more space when employed for use.

6). Most of the prior art heaters have a heater element support frame or fixtures made of metal thereby necessitating lengthy safety measures.

7). A few prior art devices employ mica sheets for supporting the heaters and mica wafers do not offer much strength and temperature resistance resulting in early failure of the heaters and the heaters suffer disadvantages in termination and connections.

8). Some of the prior art heaters have a tendency to make noise during the operation due top the loosely inserted supports which are holding the heating elements. This noise is objectionable.

9). Owing to the elaborate element support system, in the conventional, erstwhile air heaters, the size of the assembly and the resultant air heater unit is quite large leading to space wastage.

Currently hundreds of varieties of heaters are available and employed in different industrial fields. A strong compact and highly efficient heater with inbuilt support for its electric resistance elements, eliminating the need for the multiple component fixtures, holders, brackets, and railings would help in reducing the size of the heater and assembly, improve the design features and reduce the cost of manufacture while ensuring good performance and safety.

It is obvious from the description given above that most of the prior art relating to heaters has been developed by finding a means to support the heating element by means of insulators, bracket ends and coil supports to electrically conductive outer frames to produce a heater configuration. But no efforts have been made to make a frame out of a suitably designed ceramic material in such a manner that it can perform various functions of holding, insulating, separating, aligning, and eliminate sagging of the element completely while ensuring uniform temperature of the heating element. Hence it is very important to provide a device for air heating, wherein.

The heater would be compact

The heating element support is made up of a single or two component electrically insulating and heat resisting monolithic ceramic body.

The single component element holding unit would eliminate fixtures, fasteners and metal supports.

Such a device would offer various advantages to the heater in the form of flexibility of Watt density, variability in design parameters to meet different applications, allow multiple element rows and columns in any configuration and eliminates the problem of sagging completely with out any conscious efforts from the heater manufacturers; Such a heater assembly will also be energy efficient, flexible in applications, economical, noise free, easy to manufacture and offers better options to the heater designer.

OBJECTIVES OF THE PRESENT INVENTION

Therefore the main objective of the present invention is to provide an improved ceramic honeycomb monolith useful for fabricating an improved electrical heating device, which is compact and can be manufactured less laboriously and less expensively.

Another objective of the present invention is to provide an improved ceramic honeycomb monolith made of Zirconia, Alumina, and Mullite, cordierite or any other ceramic material.

Another objective of the present invention is to provide an improved electrical heating device incorporating an improved ceramic honeycomb monolith.

Yet another objective of the present invention is to provide an improved electrical heating device incorporating improved ceramic honeycomb monolith having smaller number of different component parts and with the possibility of substantial improvement in efficiency, heat density and space saving and safety.

Still another objective of the present invention is to provide an improved electrical heating device incorporating the improved ceramic honeycomb monolith which completely eliminates the various fixtures and supports that are usually associated with heating element support means, by providing a modified ceramic honeycomb monolith body to support and hold the heating elements in a most optimum way with minimum obstruction to air flow or heat flow.

Still another objective of the present invention is to provide an improved heating device incorporating the improved ceramic monolith, which is useful for heating air or any non inflammable and chemically inert gas.

Yet another objective of the present invention is to provide an improved heating device incorporating the improved honeycomb monolith, which has an inbuilt provision to hold the heating element rigidly enough to minimize or completely remove the problem of vibrating element as well as the noise created due to this vibration.

Still another objective of the present invention is to provide an improved electrical heating device employing a ceramic honeycomb monolith body made of Zirconia, Alumina, Mullite or any other suitable non conducting refractory material.

Another objective of the present invention is to provide an improved electrical heating device employing a single or multiple ceramic honeycombs to holds and support single or multiple heating elements.

Yet another objective of the present invention is to provide a ceramic honeycomb support for holding the heating element while a ceramic honeycomb with or without heating element will additionally give support to the heating elements present in the first honeycomb.

Yet another objective of the present invention is to provide a ceramic honeycomb supported electrical resistance heater with good convection efficiency while minimizing obstruction to air flow or pressure drop due to multi-walled channels of the ceramic honeycomb.

The above mentioned objectives of the present invention have been achieved based on my findings that the ceramic monolith honeycomb disclosed in the Indian patent No 200787, namely single honeycomb structured monolith of appropriate configuration made of cordierite or alumina or alumina-silica based body with plurality of parallel holes acting as channels for passage of air when air is blown or allowed to pass through them, needs to be modified in such a fashion that a few integral components of the honeycomb so modified will create a provision to hold and support the heating elements at the honeycomb channel ends in a most convenient, compact and suitable manner so as to enable placing the elements and hold them in their place all the while having the row or rows of heating element coils positioned perpendicular to the air flowing through the channels. The modification effected to the ceramic honeycomb is essentially by extending one set of parallel walls out of the honeycomb to form a cluster of parallel walls in any one preferred direction at one end of the honeycomb while these walls are still integrally connected to the unmodified part of the ceramic honeycomb monolith. This extension of walls may be at one end or both ends of the ceramic honeycomb to form element support grooves in such a way that an electric resistance heating element can be held along the grove created by pairs of adjacent parallel walls while the channels looking out to the heating element coils running across their ends can convey air from one end to another.

BRIEF DESCRIPTION OF THE DRAWINGS

Various other features and attendant advantages of the present invention will be more fully appreciated from following detailed description when considered in connection with the accompanying drawings in which like reference characters designate like or corresponding parts throughout the several views, and wherein.

SUMMARY OF THE INVENTION

Figure 1:
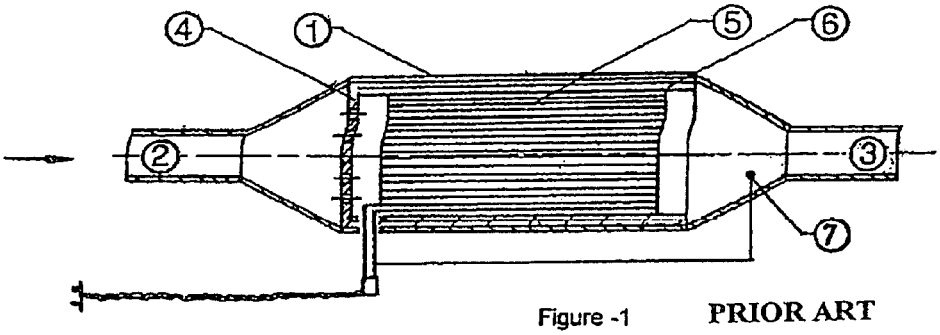
Figure -1 PRIOR ART
FIG. 1 is a cross-sectional of a first conventionally known ceramic monolith honeycomb body.
Figure 2:
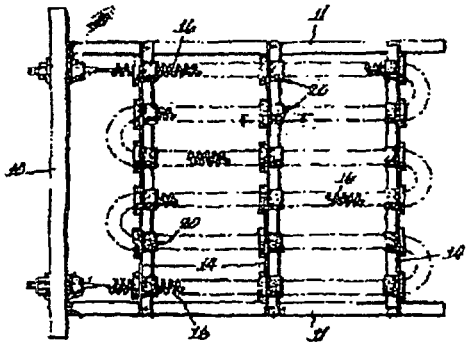
FIGURE - 2 PRIOR ART
FIG. 2 is a plan view of a first type of conventionally known open coil electric heater.
Figure 3:
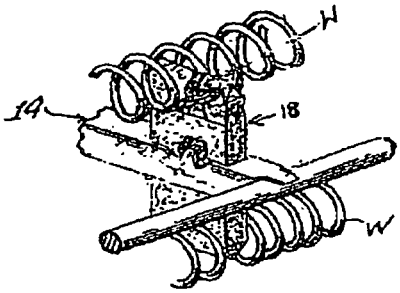
Figure -3 PRIOR ART
FIG. 3 is a perspective view of a second type of conventionally known open coil electric heater.
Figure 4:
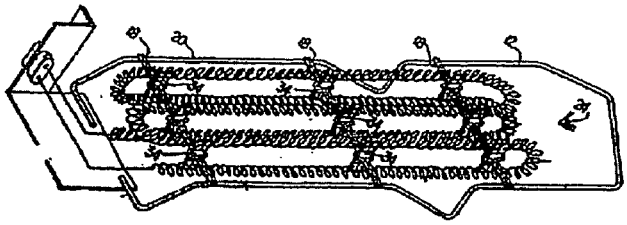
Figure 4 PRIOR ART
FIG. 4 is a perspective view of a third type of conventionally known open coil electric heater.
Figure 5:
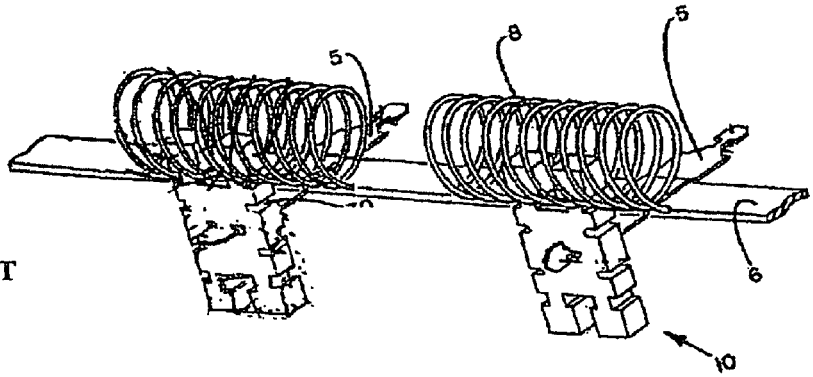
Figure 5 PRIOR ART
FIG. 5 is a perspective view of a conventionally known electrical resistance heating assembly.
Figure 6:
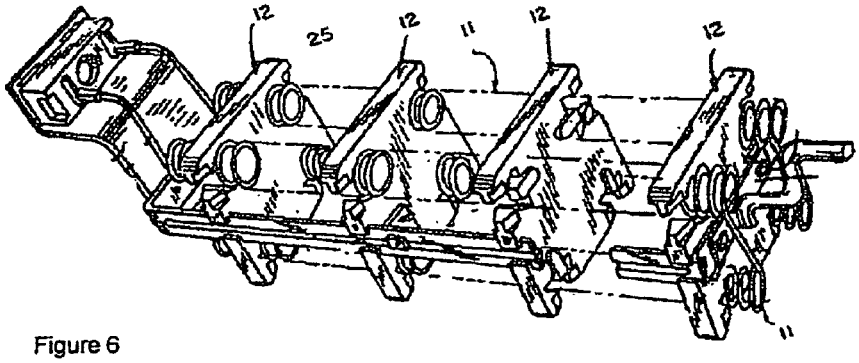
Figure 6 PRIOR ART
FIG. 6 is a perspective view of a conventionally known heating element coil support.
Figure 7:
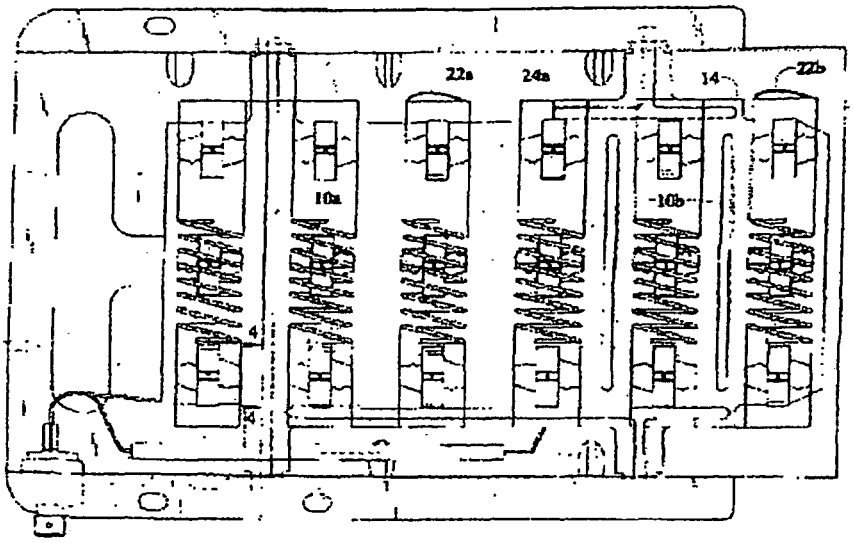
Figure 7 PRIOR ART
FIG. 7 is a plan view of a conventionally known multi-stage electric heater assembly.
Figure 8:
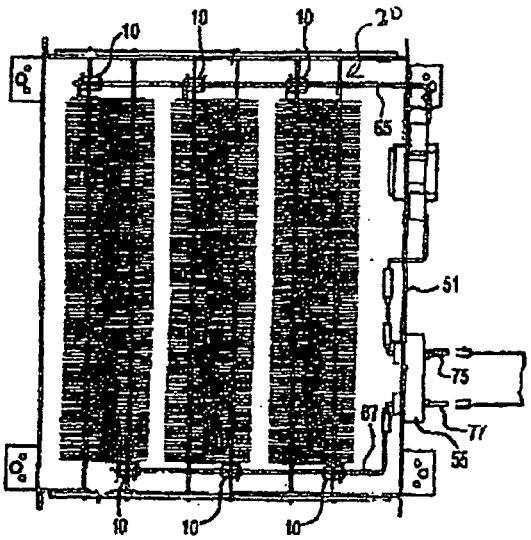
Figure 8 PRIOR ART
FIG. 8 is a plan view of a conventionally known mica board open coil resistance heater assembly.
Figure 9:
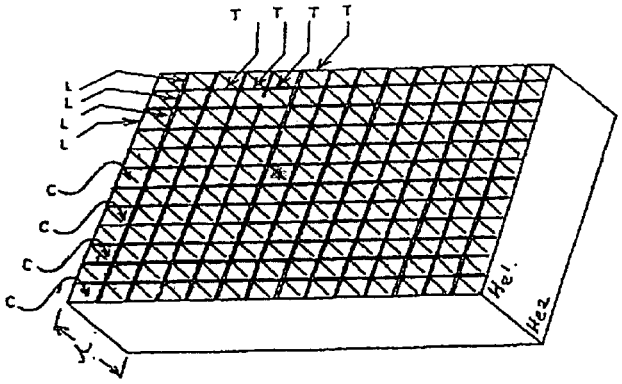
FIG. 9 is a perspective view of a second conventionally known ceramic monolith honeycomb body.
Figure 1:
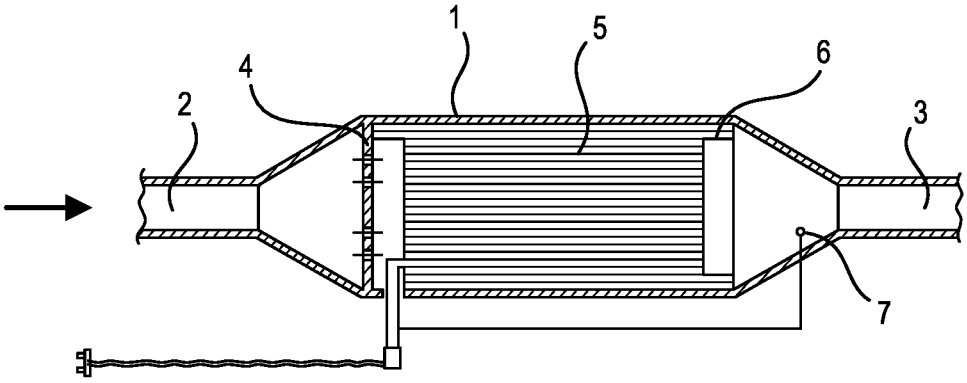
FIG. 1 (PRIOR ART)
Figure 2:
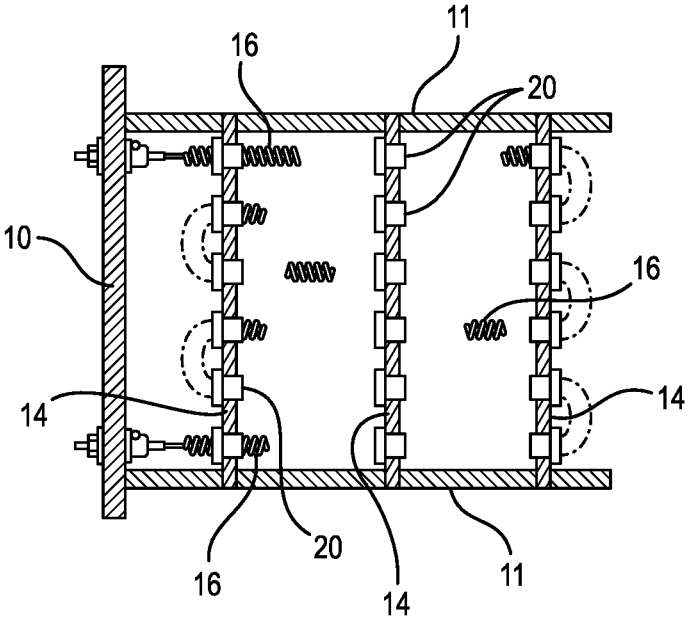
FIG. 2 (PRIOR ART)
Figure 3:
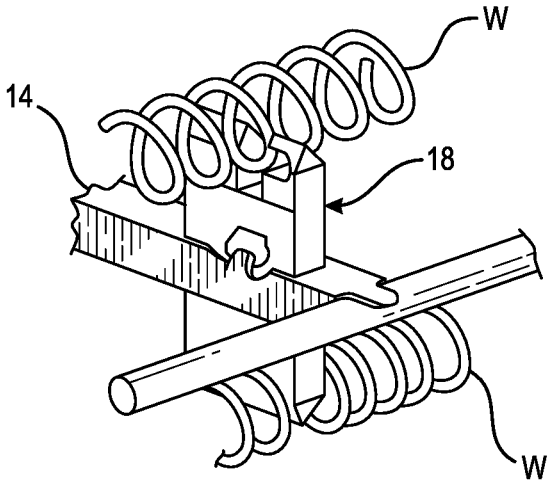
FIG. 3 (PRIOR ART)
Figure 4:
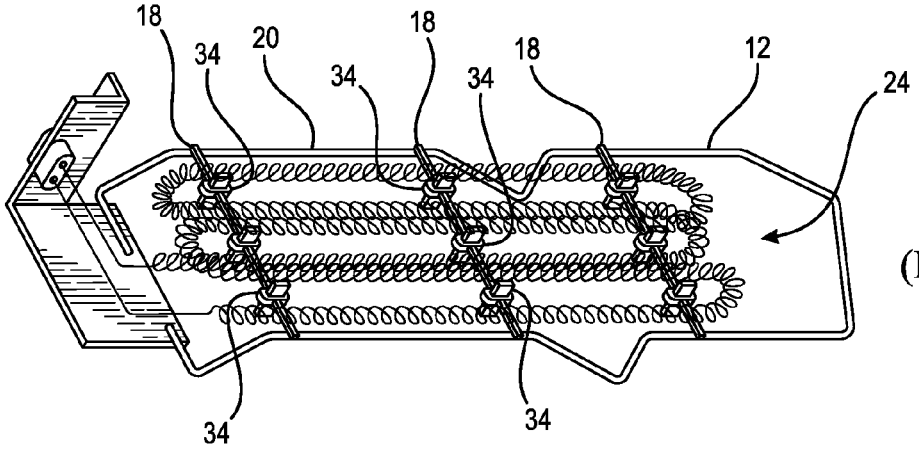
FIG. 4 (PRIOR ART)
Figure 5:
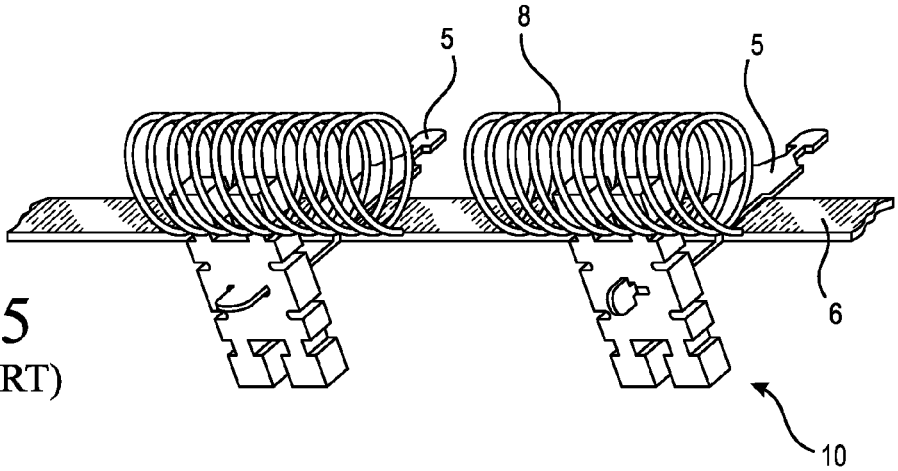
FIG. 5 (PRIOR ART)
Figure 6:
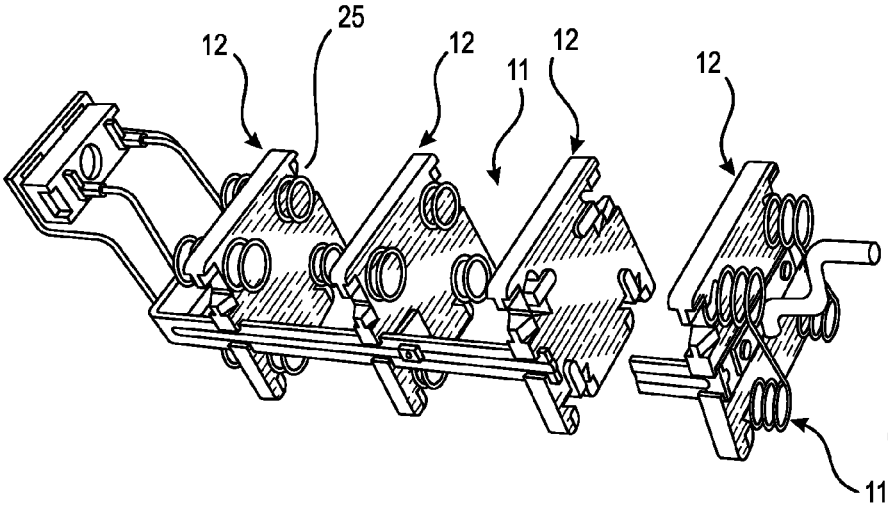
FIG. 6 (PRIOR ART)
Figure 7:
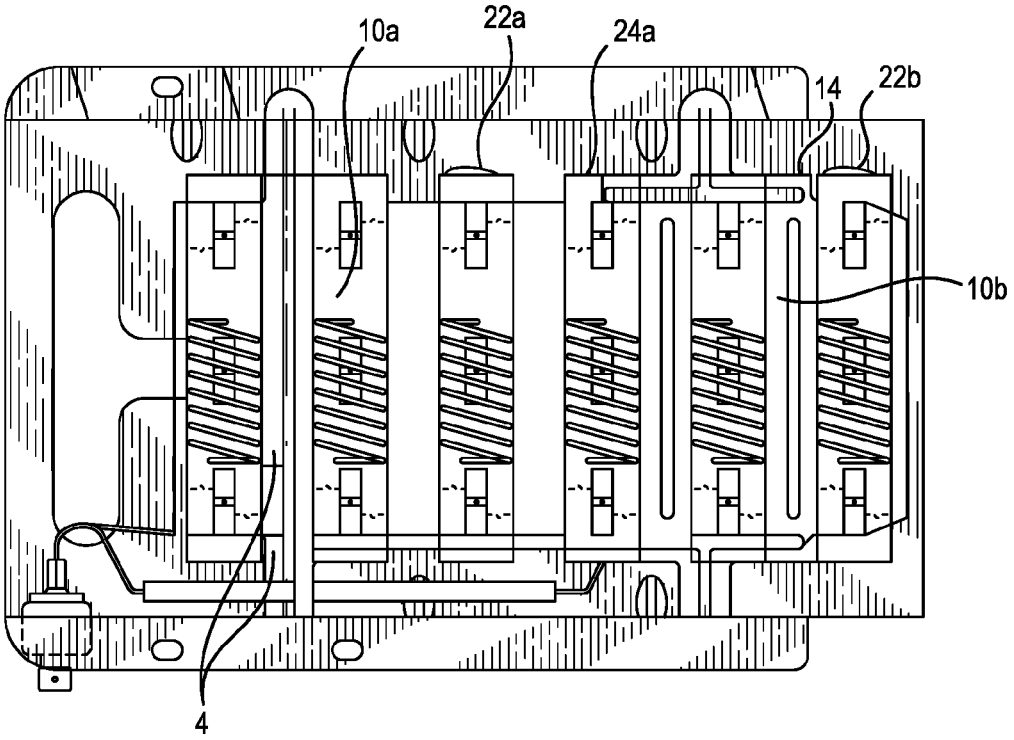
FIG. 7 (PRIOR ART)
Figure 8:
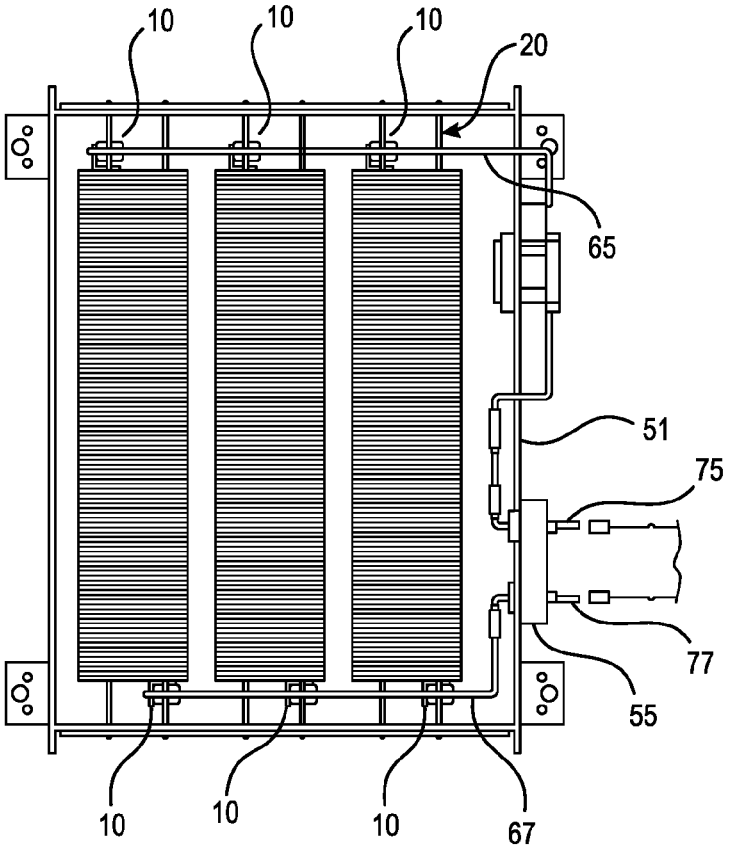
FIG. 8 (PRIOR ART)
Figure 9:
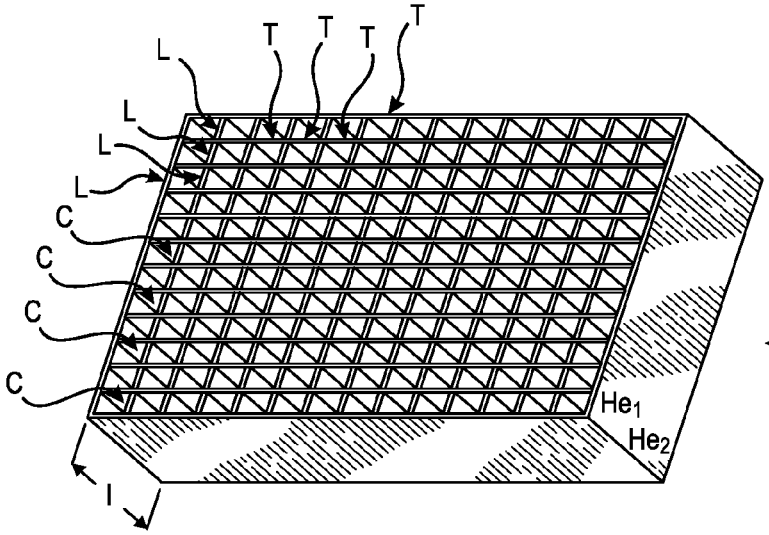
FIG. 9 (PRIOR ART)
Figure 10:
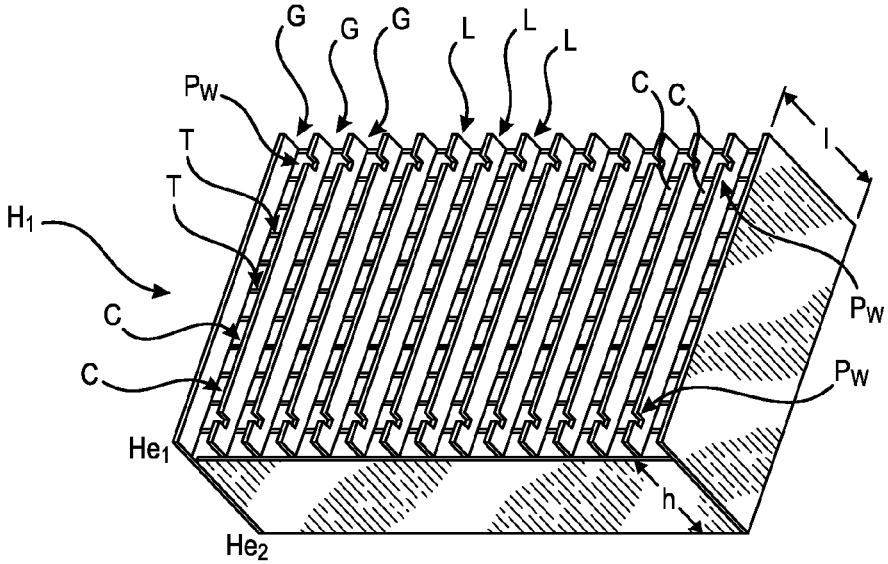
Figure 11:
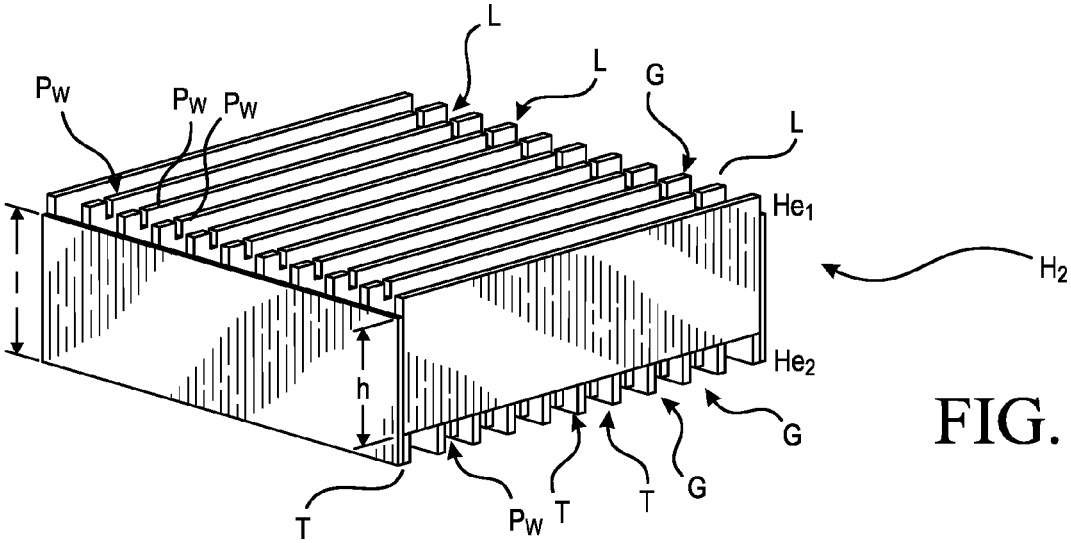
Figure 12:
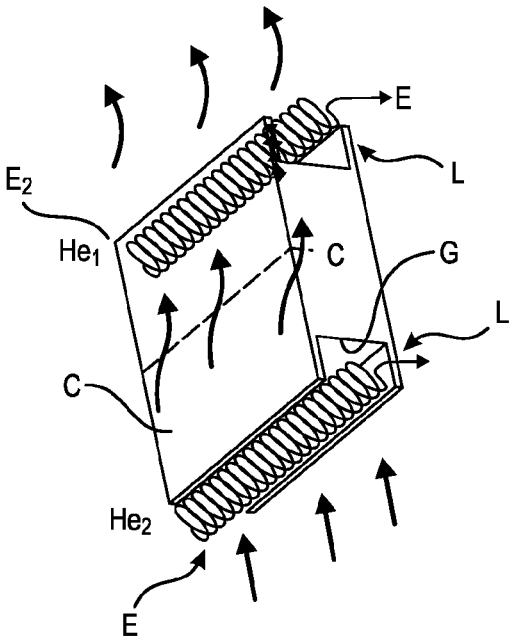
Figure 13:
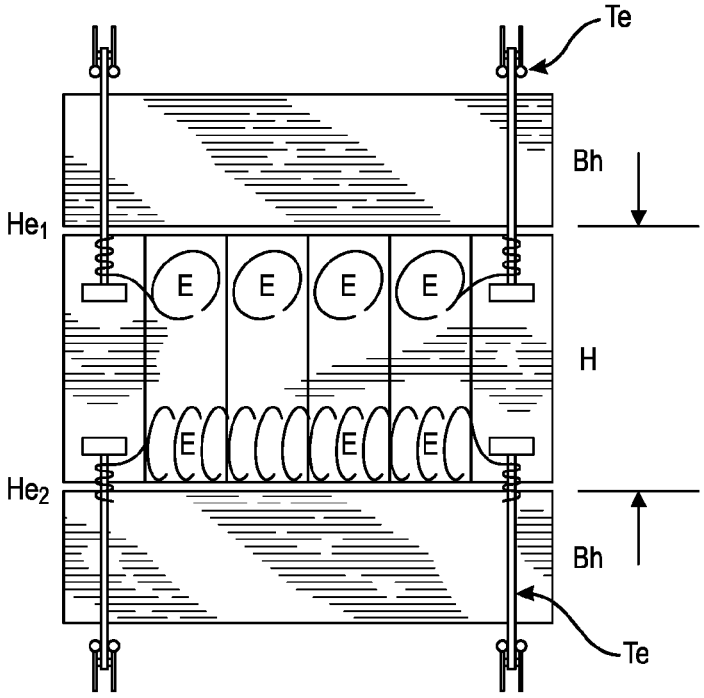
Figure 14:
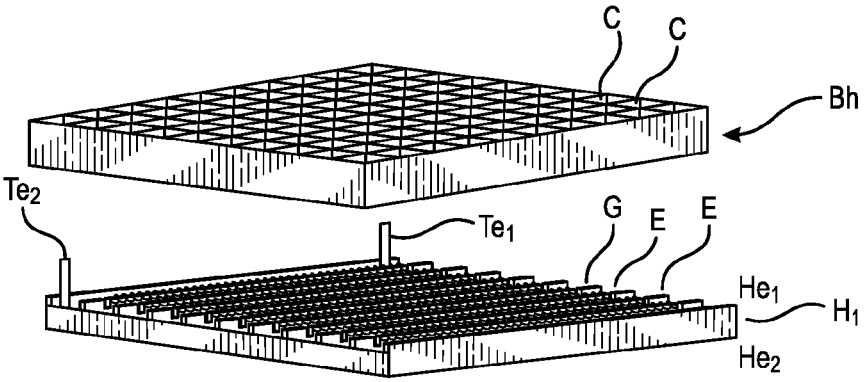

Accordingly, the present invention provides an improved ceramic honeycomb monolith ($H_1$) and ($H_2$) useful for fabrication of an improved electrical heating device which comprises of a single ceramic honeycomb monolith body (Bh) made from electrically insulating and thermally resistant ceramic material, the body being provided with plurality of channels (C) for the passage of air, the channels (C) extending parallel to one another from one end ($H_{e1}$) of the honeycomb ($B_h$) to the other end ($H_{e2}$) of the honeycomb ($B_h$). Each of these channels (C) being formed by the four walls constituting of two sets of parallel walls, the longitudinal walls (L) and transverse walls (T), the entire set of either the transverse walls (T) or the longitudinal walls (L) extending away from one end of the honeycomb ($H_{e1}$) or ($H_{e2}$): thereby making the walls (L) or (1) projecting out of the honeycomb ($B_h$), the resulting extended wall (L) or (T) being essentially parallel to one another at any end, as the case may be, the parallel walls (L or T) being always integral to the unmodified part (h) of the honeycomb ($H_1$ or $H_2$) and cumulatively forming into a row of parallel groves (G), each grove originating from two adjacent walls (L) or (T) and capable of holding an electrical heating element (E), a passage way ($P_w$) being provided at both ends of the walls (L) or (T), for the passage of heating element (E) from one grove to another.

According to another embodiment of the present invention there is provided an improved electrical heating device which comprises of a single ceramic honeycomb monolith body ($B_h$) made from electrically insulating and thermally resistant ceramic material, the body being provided with plurality of channels (C) for the passage of air, the channels (C) extending parallel; to one another from one end ($He_1$) of the honeycomb ($B_h$) to the other end ($He_2$) of the honeycomb ($B_h$) each of these channels (C) being formed by the four walls constituting of two sets of parallel walls, the longitudinal walls (L) and the transverse Walls (T), the entire set of either transverse walls (T) or the longitudinal walls (L) extending away from one end of the honeycomb ($He_1$) or ($He_2$), there by making the walls (L) or (T) projecting out of the honeycomb ($B_h$), the resulting extended walls (L) or (T) being essentially parallel to one another at any end, as the case may be, the parallel walls (L) or (T) being always integral to the unmodified part (h) of the honeycomb ($H_1$) or ($H_2$) and cumulatively forming into a row of parallel groves (G), each grove originating from two adjacent walls (L) or (T), the groves holding an electrical heating element (E), a passage way ($P_w$) being provided at both the ends of the wall (L) or (T), for the passage of heating element (E) from one grove to other, the ends of the heating element (E) being provided with terminals (Te) for connecting to the power source.

The ceramic material used for making the honeycomb monolith may be selected from Alumina, Zirconia, Cordierite, Mullite, and Steatite or any other ceramic materials.

In the preferred embodiment of the invention, a known honeycomb ($B_h$) of similar channel cross section may be placed and fixed over the honeycomb end ($H_{e1}$) of the electrical heating device defined above while the fixing can be effected employing a ceramic cement of suitable quality. The terminal electrodes ($T_e$) of the heating elements (E) are taken out of two empty channels thus providing a heater with electrical heating elements in complete communion with air flowing through the channels resulting in an efficient and economical heating device with superior insulation features.

In another preferred embodiment of the present invention the known honeycomb ($B_h$) and the improved honeycomb monolith ($H_1$) or ($H_2$) carrying the electrical resistance elements (E) are held together by means of a ceramic cement applied to the outer walls of both the honeycombs or by means of suitable screws and nuts fitted into the empty channels at the four corners of the two honeycombs. Alternately the Terminal electrodes (Te) can serve the dual function of fasteners and as well as electrical terminals.

A similar configuration may be arranged at the other end ($He_2$) of the honeycomb ($H_2$) as in FIG. (13) thereby forming a complete heating device with heating elements (E) facing each other from across both ends ($He_1$ & $He_2$) of the honeycomb ($H_2$) in almost all the channels. The elements (E) at either end of the honeycomb ($H_2$) could be parallel to one another as shown in FIG. (12) or could be at right angles as shown FIG. (13). either of these arrangements offers similar advantages. The entire group of heating elements could be connected to a power source in series or individually or partly in parallel. The element ends are securely terminated to thicker gauge terminal electrodes ($T_e$) by means of crimping.

In yet another preferred embodiment of the present invention, one or more ceramic honeycombs ($H_2$) have inlaid heater elements (E) always essentially parallel to one another in one end ($He_1$) of the honeycomb ($H_2$) while being either parallel or perpendicular to the set of elements at the other end ($He_2$) or in the next honeycomb as shown in FIG. (13).

Yet another preferred embodiment of the present invention employs a single or multiple ceramic honeycomb ($H_1$) with inlaid heating elements parallel to one another and in such a way that all the honeycombs ($H_1$) are in tandem and also the flowing air or fluid passes from one honeycomb to the other in succession as shown in FIG. (15).

In another preferred embodiment the improved heating device has a single or multiple configurations involving one or more improved ceramic honeycomb monoliths and one or more heating elements in coiled, sinusoidal, zigzag or straight wire depending on the application.

In yet another preferred embodiment essentially for heating units, when honeycomb channel axis and passing air flow are both horizontally positioned, a small segment of the circular windings of the heating element coils (E) are partially pushed into the unmodified channel portion (h) lying underneath, so that the windings receive more support from the honeycomb channel's transverse walls (T) or the longitudinal walls (L) available at that level and this results in only a few number of windings taking the support from each transverse wall of the honeycomb structure available below the heating element, thus ensuring minimum stretching of the winding when the said heating element is heated due to the negligible unsupported self weight of the heating element at any given portion of the coil winding. This also reduces the sagging very significantly FIG. (13).

Figure 15:
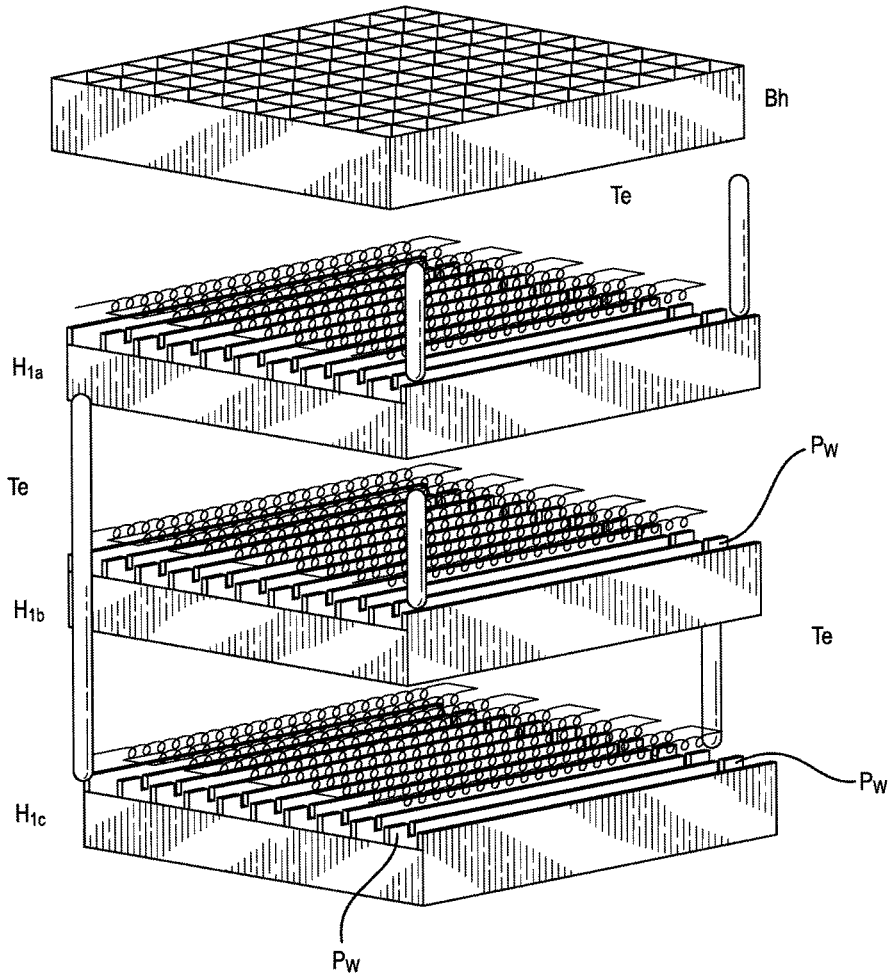

In another preferred embodiment, where more than two honeycombs ($H_{1a}$ and $H_{1b}$ and $H_{1c}$) as shown in FIG. 15 with the electrical resistance heating elements (E) are stacked together, only one end winding is allowed in each honeycomb, while its bare end will cover the elements in the honeycomb below it. The Extreme end of the composite body ($H_{1a}$) in which the rows of heating element (E) are open to touch otherwise, will be covered by a bare ceramic honeycomb ($B_h$), with the terminal electrodes ($T_e$) suitably brought out to respective empty channels of individual honeycombs, such that both extreme ends of the terminals can be connected to power source.

In yet another preferred embodiment ceramic honeycombs having different outer body cross section visa vie—square, round, elliptical, rectangular, and hexagonal and other geometrical shapes may be employed to serve as the support structure for electrical resistance heating elements.

In yet another preferred embodiment, ceramic honeycomb with channels/pores of different cross sectional shapes like square, round, hexagonal triangular etc and of various lengths can be used to support and hold the electrical heating elements (E).

The improved electric heating device as disclosed in this invention provides minimum assembled components as the element is securely held in between two walls and a bottom support of one honeycomb, while the top is protected by either with a bare end of a second improved ceramic honeycomb heater ($H_1$) or alternately with a bare ceramic honeycomb itself all the while ensuring excellent air flow owing to the high open surface area of the honeycomb as well as the short wall length (l) of the honeycomb.

This invention does away with multiple support components as the heating device, as a unit, can be assembled in any enclosure with minimum of further external insulation.

This invention does more than the reduction of components. Due to the compactness of the system, higher watt densities can be designed keeping in mind the excellent air to heating element contact that is made possible by the ceramic honeycomb channels and the small but complete and uniform exposure of each segment of the heating element in the individual channel on one end simultaneously to the flowing air.

Besides the above mentioned embodiments which are disclosed herein, various modified configurations involving the resistance heating elements are possible so that different watt densities, Operating voltages, Ohmic values can be employed by subtle changes in connecting the resistances in parallel and/or series as per the design needs without any design constraints originating from the heater body.

Working of the Device

The working of the heating device of the present invention is very similar to the conventional radiation and convection heaters. However, when the heating element (E) positioned in the groves (G) of the honeycomb ($H_1$) or ($H_2$) connected to the terminal lead wires (Te) securely, is energized, the electrical resistance elements (E) generate heat. All the rows of the heating elements (E) that are energized are protected from each other by the walls (L) or (T) in between neighboring electrical heating elements (E), and held in their position due to the known honeycomb ($B_h$) surface from above and the unmodified portion (h) of the honeycomb channel left out below as shown in FIG. (13). On heating the element (E) expands slightly thus ensuring further improved grip.

When air is blown through the channels (C) from one end of the improved heater incorporating improved honeycomb ($H_1$) or ($H_2$), it comes in to direct contact with the evenly and closely laid rows of electrical resistance heating elements (E) of predetermined Ohmic value, resulting in efficient convective heat transfer. Since the heating device of the present invention is devoid of multiple supporting and insulating components and fasteners, cramping the available space, more attention and space can be a accorded to the heating element itself, thereby ensuring a fairly compact heater design because of which the air passing through the channel is in most optimum contact with the electrical heating element thus providing an efficient and inexpensive air heater which can also be relatively safe and simple.

In dual end heating element as shown in FIG. (13) multiple heater arrangements, on closer observations it can be seen that each channel has a small section of the heating element in suspension at both of its ends. Both these sections heated up on receiving power supply. When air flows into the channel through the first End ($H_{e1}$), it gets heated up to a certain extent, and during its exit at other end ($H_{e2}$) gets heated up further, due to the heating element present at the exit end ($H_{e2}$) as shown in FIG. (12).

The electric heating device of the present invention throws open the possibility of simplifying most of the existing conventional air heating devices, infrared heating devices, radiant heating and other heating devices be it for space heating, room heating, high temperature air or radiant heating and even in many air conditioning applications.

Advantages of the Invention

1). The improved ceramic honeycomb monolith when used for fabricating a heater will facilitate placing the heating elements perpendicular to the direction of the air flow and with minimum of inter row spacing. Such a construction will help in achieving higher wattages and maintaining uniform temperature of the heating elements, during its operation as a heater, which will enhance the life of the heater appreciably.

2). The improved electric heating device is compact, highly efficient, simple in design, with relatively higher watt density, easy to fabricate and assemble and manufactured from easily available materials and offers more continuous support to the element and better thermo-mechanical support to the individual heating element while minimizing the need of all the elaborate fixtures and fittings generally associated with the electric resistance heating element support and with improved safety, while offering excellent trouble free usage and at the same time economical to manufacture.

3). The improved electrical heating device can replace many oversized conventional heating equipments of erstwhile designs, saving appreciable space.

4). the improved electrical heating device throws open the possibility of simplifying most of the existing conventional air heating devices be it for space heating, infrared heating, high temperature air heating and even many air conditioning needs.

5). The improved electric heating device does not make noise when the elements are energized due to the snug fitting of the elements in between the walls and channels of the honeycomb.

6). Since the inter element gap can be minimized to almost the thickness of the walls (L) or (T) of the grove (G) longer element can be accommodated in a given space thus improving the watt density and conversely thicker gauge heating element (E) can be employed, indirectly improving the element life.

7). It is unique to this invention that a single monolith ceramic honeycomb offers its strong, rigid and modified channel structure, good strength coupled with insulation and a design to provide a maximum heat delivery from with in a minimum of space.

8). Depending on the heater watt rating desired, a compact arrangement of multiple heaters with a thin wafer of bare honeycomb sandwiched in between, these heaters can give rise to a very high density air heaters with multiple benefits and high heating and convection efficiency.

9). Very high wattage can be accommodated using this device while ensuring good heat transfer and low heat mass suitable for many applications in both radiant and convection heating.

The invention claimed is:

1. A ceramic honeycomb monolith useful for the fabrication of an electrical heating device, comprising:

a ceramic honeycomb body structure comprising electrically insulating and thermally resistant materials and having a solid geometrical configuration;

wherein said honeycomb body structure comprises a plurality of longitudinally extending parallel walls which extend continuously from one end of said honeycomb body structure to an opposite end of said honeycomb body structure, and a plurality of transversely extending parallel walls which traverse said plurality of longitudinally extending parallel walls and which extend continuously from one side of said honeycomb body structure to an opposite side of said honeycomb body structure such that together, said plurality of longitudinally extending parallel walls and said plurality of transversely extending parallel walls define a plurality of four-sided channels for the passage of air therethrough;

wherein said plurality of longitudinally extending parallel walls and said plurality of transversely extending parallel walls are offset with respect to each other such that first end portions of said plurality of longitudinally extending parallel walls extend beyond first end portions of said plurality of transversely extending parallel walls so as to define a plurality of longitudinally extending grooves between adjacent ones of said plurality of longitudinally extending parallel walls, while second end portions of said plurality of transversely extending parallel walls extend beyond second end portions of said plurality of longitudinally extending parallel walls so as to define a plurality of transversely extending grooves between adjacent ones of said plurality of transversely extending parallel walls; and a plurality of electrical heating elements disposed within said plurality of longitudinally extending grooves and within said plurality of transversely extending grooves for heating air as the air passes through said plurality of longitudinally extending grooves, through said plurality of transversely extending grooves, and through said plurality of four-sided channels.

2. The ceramic honeycomb monolith as claimed in claim 1, wherein:

the ceramic material used for making the honeycomb monolith is selected from the group comprising alumina, zirconia, cordierite mullite, and steatite.

3. The ceramic honeycomb monolith as claimed in claim 1, wherein:

a first conventional honeycomb, similar to said ceramic honeycomb monolith in that said first conventional honeycomb comprises four-sided channels formed from a plurality of longitudinally extending parallel walls and a plurality of transversely extending parallel walls, is fixed atop said ceramic honeycomb monolith by ceramic cement.

4. The ceramic honeycomb monolith as claimed in claim 3, wherein:

said first conventional honeycomb and said ceramic honeycomb monolith are fixed together by fasteners.

5. The ceramic honeycomb monolith as claimed in claim 3, wherein:

a second conventional honeycomb, similar to said ceramic honeycomb monolith in that said second conventional honeycomb comprises four-sided channels formed from a plurality of longitudinally extending parallel walls and a plurality of transversely extending parallel walls, is also fixed beneath said ceramic honeycomb monolith thereby forming a three-tier electrical heating device.

6. The ceramic honeycomb monolith as set forth in claim 5, wherein:

heating elements are disposed within said four-sided channels of said second conventional honeycomb, wherein said heating elements contained within said ceramic honeycomb monolith and said heating elements contained within said second conventional honeycomb are oriented in directions perpendicular with respect to each other.

7. The ceramic honeycomb monolith as claimed in claim 3, wherein:

said electrical heating elements comprise terminal electrodes; and said terminal electrodes, in addition to serving as end terminals for said electrical heating elements, also comprise fasteners for fixing said second conventional honeycomb and said ceramic honeycomb monolith together.

8. The ceramic honeycomb monolith as set forth in claim 3, wherein:

heating elements are disposed within said four-sided channels of said second conventional honeycomb, wherein said heating elements contained within said ceramic honeycomb monolith and said heating elements contained within said second conventional honeycomb are oriented in directions perpendicular with respect to each other.

9. The ceramic honeycomb monolith as claimed in claim 1, wherein:

said electrical heating elements have configurations selected from the group comprising coiled, sinusoidal, zigzag, and straight.

10. The ceramic honeycomb monolith as claimed in claim 1, wherein:

said solid geometrical configuration of said ceramic honeycomb body structure of said ceramic honeycomb monolith has a cross-sectional configuration which is selected from the group comprising a square, a circle, an ellipse, a rectangle, and a hexagon.

11. The ceramic honeycomb monolith as set forth in claim 1, wherein:

said four-sided channels defined within said ceramic honeycomb monolith have cross-sectional configurations which are selected from the group comprising a square, a circle, a triangle, a rectangle, and a hexagon.

12. The ceramic honeycomb monolith as set forth in claim 1, wherein:

said plurality of longitudinally extending grooves and said plurality of transversely extending grooves are disposed within different planes parallel to each other.

13. The ceramic honeycomb monolith as set forth in claim 12, wherein:

said plurality of longitudinally extending grooves and said plurality of transversely extending grooves extend in directions which are perpendicular to each other.

14. The ceramic honeycomb monolith as set forth in claim 12, wherein:

said plurality of longitudinally extending grooves and said plurality of transversely extending grooves extend in planes which are perpendicular to the axes of said plurality of four-sided channels defined within honeycomb body structure.

15. The ceramic honeycomb monolith as set forth in claim 1, wherein:

said plurality of longitudinally extending walls defining said plurality of longitudinally extending grooves, and said plurality of transversely extending walls defining said plurality of transversely extending grooves, have passageways defined therein for permitting portions of said plurality of heating elements, disposed within said plurality of longitudinally extending grooves, and portions of said plurality of heating elements disposed within said plurality of transversely extending grooves, to respectively extend from one of said plurality of longitudinally extending grooves into an adjacent one of said plurality of longitudinally extending grooves, and to extend from one of said plurality of transversely extending grooves into an adjacent one of said plurality of transversely extending grooves.

16. The ceramic honeycomb monolith as set forth in claim 1, wherein:

said plurality of heating elements comprise infrared heating elements.

17. The ceramic honeycomb monolith as set forth in claim 1, wherein:

said plurality of heating elements comprise electrical resistance heating elements.

18. The ceramic honeycomb monolith as set forth in claim 1, wherein:

said plurality of heating elements can all be connected to a power source in series.

19. The ceramic honeycomb monolith as set forth in claim 1, wherein:

first and second ones of said plurality of heating elements can be separately connected to a power source in parallel.

20. A ceramic honeycomb monolith useful for the fabrication of an electrical heating device, comprising:

a ceramic honeycomb body structure comprising electrically insulating and thermally resistant materials and having a solid geometrical configuration;

wherein said honeycomb body structure comprises a plurality of longitudinally extending parallel walls which extend continuously from one end of said honeycomb body structure to an opposite end of said honeycomb body structure, and a plurality of transversely extending parallel walls which traverse said plurality of longitudinally extending parallel walls and which extend continuously from one side of said honeycomb body structure to an opposite side of said honeycomb body structure such that together, said plurality of longitudinally extending parallel walls and said plurality of transversely extending parallel walls define a plurality of four-sided channels for the passage of air therethrough;

wherein first end portions of said plurality of longitudinally extending parallel walls extend beyond first end portions of said plurality of transversely extending parallel walls so as to define a plurality of longitudinally extending grooves between adjacent ones of said plurality of longitudinally extending parallel walls; and a plurality of electrical heating elements disposed within said plurality of longitudinally extending grooves for heating air as the air passes through said plurality of longitudinally extending grooves and through said plurality of four-sided channels.

21. The ceramic honeycomb monolith as set forth in claim 20, wherein:

said plurality of longitudinally extending parallel walls also extend below second end portions of said plurality of transversely extending parallel walls so as to define a second plurality of longitudinally extending grooves between adjacent ones of said plurality of longitudinally extending parallel walls; and a second plurality of electrical heating elements disposed within said second plurality of longitudinally extending grooves for heating air as the air passes through said second plural set of longitudinally extending grooves and through said plurality of four-sided channels.

22. The ceramic honeycomb monolith as set forth in claim 21, wherein:

said plurality of electrical heating elements disposed within said plurality of longitudinally extending grooves, and said second plurality of electrical heating elements disposed within said second plurality of longitudinally extending grooves, are disposed parallel to each other.

23. The ceramic honeycomb monolith as claimed in claim 20, wherein:

a first conventional honeycomb, similar to said ceramic honeycomb monolith in that said conventional honeycomb comprises four-sided channels formed from a plurality of longitudinally extending parallel walls and a plurality of transversely extending parallel walls, is fixed atop said ceramic honeycomb monolith by ceramic cement.

24. The ceramic honeycomb monolith as claimed in claim 20, wherein:

a second honeycomb body monolith, similar to said honeycomb body monolith, is disposed atop said honeycomb body monolith; and a first conventional honeycomb, similar to said second ceramic honeycomb monolith in that said conventional honeycomb comprises four-sided channels formed from a plurality of longitudinally extending parallel walls and a plurality of transversely extending parallel walls, is fixed atop said second ceramic honeycomb monolith.

* * * * *

UNITED STATES PATENT AND TRADEMARK OFFICE

CERTIFICATE OF CORRECTION

PATENT NO. : 8,987,643 B2
APPLICATION NO. : 13/321618
DATED : March 24, 2015
INVENTOR(S) : Sundereswar Rao Vempati Venkata It is certified that error appears in the above-identified patent and that said Letters Patent is hereby corrected as shown below:

Please delete the Title page and insert the Title Page showing the illustrative figure shown on the attached Title page.

On the title page, under abstract "24 Claims, 4 Drawing Sheets" should read -- 24 Claims, 6 Drawing Sheets --.

Please replace FIGS. 1-9 with FIGS. 1-15 as shown on the attached pages.

Signed and Sealed this
Twelfth Day of January, 2016

Michelle K. Lee

Michelle K. Lee
*Director of the United States Patent and Trademark Office*

(12) United States Patent
Vempati Venkata

(10) Patent No.: US 8,987,643 B2
(45) Date of Patent: Mar. 24, 2015

(54) CERAMIC MONOLITH AND AN ELECTRIC HEATING DEVICE INCORPORATING THE SAID MONOLITH

(76) Inventor: Sundereswar Rao Vempati Venkata, Secunderabad (IN)

( * ) Notice: Subject to any disclaimer, the term of this patent is extended or adjusted under 35 U.S.C. 154(b) by 704 days.

(21) Appl. No.: 13/321,618

(22) PCT Filed: Jul. 20, 2009

(86) PCT No.: PCT/IN2009/000415
§ 371 (c)(1),
(2), (4) Date: Nov. 21, 2011

(87) PCT Pub. No.: WO2011/010317
PCT Pub. Date: Jan. 27, 2011

(65) Prior Publication Data
US 2012/0061379 A1 Mar. 15, 2012

(51) Int. Cl.
*H05B 3/10* (2006.01)
*H05B 3/50* (2006.01)
*F24H 3/04* (2006.01)
*F24H 9/18* (2006.01)

(52) U.S. Cl.
CPC ..... *H05B 3/50* (2013.01); *F24H 3/0405* (2013.01); *F24H 3/0429* (2013.01); *F24H 9/1863* (2013.01); *H05B 2203/023* (2013.01)
USPC ..... 219/553; 219/536

(58) Field of Classification Search
USPC ..... 219/532, 541–542, 546, 536–537, 548, 219/552, 550; 315/111.21; 428/116, 117
See application file for complete search history.

(56) References Cited

U.S. PATENT DOCUMENTS

| | | | | |
|---|---|---|---|---|
| 3,883,721 | A | 5/1975 | Paulson et al. | |
| 4,250,399 | A | 2/1981 | King | |
| 4,458,141 | A | 7/1984 | Howard et al. | |
| 4,578,441 | A | 7/1985 | Seal et al. | |
| 4,692,599 | A | 9/1987 | Howard et al. | |
| 5,122,640 | A | 6/1992 | Holmes | |
| 5,925,273 | A | 7/1999 | Shemill | |
| 6,884,974 | B2 | 4/2005 | Howard et al. | |
| 2002/0139793 | A1 * | 10/2002 | Whitfield | 219/536 |
| 2006/0152163 | A1 * | 7/2006 | Miki et al. | 315/111.21 |

FOREIGN PATENT DOCUMENTS

IN 200787 B 2/2007

OTHER PUBLICATIONS

International Search Report dated Jun. 15, 2010 in corresponding International Application No. PCT/IN2009/000415.

* cited by examiner

*Primary Examiner* Dana Ross
*Assistant Examiner* Phuong Nguyen
(74) *Attorney, Agent, or Firm* Law Offices of Steven W. Weinrieb

(57) ABSTRACT

The present invention relates to an improved electrical heating device for forced convection heating as well as for radiant heating, the device having minimum number of element supporting components and with the heating element held and supported between two parallel walls of a modified ceramic honeycomb, in such a way that the supported element is perpendicular to the direction of the air flow while being open to air flowing through the channels the heating element being also protected from direct physical contact with the metallic body of the outer shell/enclosure.

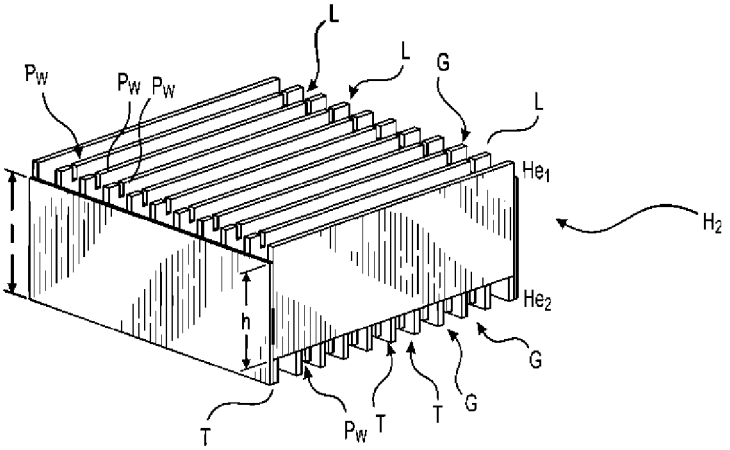

24 Claims, 6 Drawing Sheets